US012167746B2

(12) United States Patent
Partouche

(10) Patent No.: US 12,167,746 B2
(45) Date of Patent: Dec. 17, 2024

(54) SET OF STICK-SHAPED FILTERS MADE OF CARDBOARD, PREFORM FOR THE MANUFACTURE THEREOF AND PACKAGING THEREOF

(71) Applicant: Republic Technologies (NA) LLC, Glenview, IL (US)

(72) Inventor: Olivier Partouche, Barcelona (ES)

(73) Assignee: Republic Technologies (NA) LLC, Glenview, IL (US)

( * ) Notice: Subject to any disclaimer, the term of this patent is extended or adjusted under 35 U.S.C. 154(b) by 301 days.

(21) Appl. No.: 17/615,730

(22) PCT Filed: Jun. 3, 2020

(86) PCT No.: PCT/IB2020/055214
§ 371 (c)(1),
(2) Date: Dec. 1, 2021

(87) PCT Pub. No.: WO2020/245730
PCT Pub. Date: Dec. 10, 2020

(65) Prior Publication Data

US 2022/0240570 A1 Aug. 4, 2022

(30) Foreign Application Priority Data

Jun. 7, 2019 (FR) ..... 1906092

(51) Int. Cl.
*A24D 3/04* (2006.01)
*A24D 3/10* (2006.01)
*B65D 85/10* (2006.01)

(52) U.S. Cl.
CPC ..... *A24D 3/04* (2013.01); *A24D 3/10* (2013.01); *B65D 85/10* (2013.01)

(58) Field of Classification Search
None
See application file for complete search history.

(56) References Cited

U.S. PATENT DOCUMENTS 3,640,287 A * 2/1972 Pinkham ..... A24D 3/045 131/201
2009/0155512 A1 6/2009 Neto et al.
(Continued)

FOREIGN PATENT DOCUMENTS

CN 205456017 U 8/2016
CN 106471187 A 3/2017
(Continued)

OTHER PUBLICATIONS

Crutch Cards (https://www.instagram.com/crutch.cards/), printed from the Internet on Apr. 30, 2024 (Year: 2013).*
(Continued)

*Primary Examiner* — Dionne W. Mayes
(74) *Attorney, Agent, or Firm* — Lerner David LLP

(57) ABSTRACT

The present invention relates in particular to a set (2) of filters (10) made of cardboard or cellulosic material. In particular, the set is characterised by the fact that it is in the shape of a generally cylindrical stick which is made up of a plurality of individual filters (10), each formed of a winding on itself of a side made of cardboard or cellulosic material, said filters (10) being arranged in extension of one another and being partially connected in pairs by connecting means (3), such that it is possible to separate at least one filter (10) from. tile stick by removing or severing tile connecting means (3).

5 Claims, 4 Drawing Sheets

(56) References Cited

U.S. PATENT DOCUMENTS

| | | | |
|---|---|---|---|
| 2015/0189914 | A1 | 7/2015 | Simpson et al. |
| 2017/0037579 | A1 | 2/2017 | Marietta-Tondin et al. |

FOREIGN PATENT DOCUMENTS

| | | | |
|---|---|---|---|
| FR | 3057441 | A1 | 4/2018 |
| GB | 2383252 | A | 6/2003 |
| JP | 2016171831 | A | 9/2016 |
| WO | 2015014999 | A1 | 2/2015 |
| WO | 2018007300 | A1 | 1/2018 |

OTHER PUBLICATIONS

Reddit.com Post: "Local weed shops business cards are perforated to make filters/crutches for joints." https://www.reddit.com/r/DesignPorn/comments/am37nz/local_weed_shops_business_cards_are_perforated_to/, printed from the Internet on Apr. 30, 2024 (Year: 2019).*

International Search Report for Application No. PCT/IB2020/055214, dated Jul. 24, 2020, 3 pages.

* cited by examiner

SET OF STICK-SHAPED FILTERS MADE OF CARDBOARD, PREFORM FOR THE MANUFACTURE THEREOF AND PACKAGING THEREOF

CROSS-REFERENCE TO RELATED APPLICATIONS

The present application is a national phase entry under 35 U.S.C. § 371 of International Application No. PCT/IB2020/055214 filed Jun. 3, 2020, which claims priority from French Application No. 1906092 filed Jun. 7, 2019, all of which are incorporated herein by reference.

FIELD OF THE INVENTION

The present invention relates to the field of smoking articles and particularly cigarettes. More specifically, the present invention relates to the field of rolling cigarettes, in particular filters for rolling cigarettes, asymmetric or non-asymmetric manufactured tubes or cones.

TECHNOLOGICAL BACKGROUND OF THE INVENTION

Many types of cigarette filters or asymmetric or non-asymmetric manufactured tubes (cones) for smokers are known.

Usually, these filters are composed of cylindrical blocks of foam or cellulose. Cigarette filters allow filtering some substances contained in tobacco, and thus reducing the impact of tar and nicotine, as well as softening the smoke.

Coarser filters 10 for cigarettes are also known, as illustrated in the appended FIGS. 1 to 3, produced by rolling a cardboard web or a cellulose-based material. These filters are generally referred to as "toncar" which is the back slang of "carton" (cardboard) in French, or tip.

There are many types of cardboard filters in the form of a booklet or a roll, printed or unprinted, delivered flat or non-flat, and which the user rolls up when forming a cigarette. There are also ready-to-use pre-rolled filters, as there are asymmetric or non-asymmetric manufactured tubes, with this same type of pre-rolled filters.

The use of a cardboard filter tip 10 allows the rolling paper user to position a filter at the cigarette tip to prevent the tobacco from coming out of the cigarette and going into the mouth. It also allows smoking all of the cigarette tobacco without getting burned.

Generally, the known filter tips 10 are rolled on themselves to form by folding an "S" 11 or similar geometry, in order to create the interior of the filter and obstruct the passage of the tobacco, then different turns 12 on the outside of the initial "S" shape 11.

FIGS. 4 and 5 illustrate, without limitation, other examples of such filter tips, in which the folding 11 has respectively the shape of the letters "W" and "M".

Reference may be made in particular to document FR3057441 in the name of the present applicant for more detail on the manufacturing technique of such a filter.

Once a smoker wishes to buy such already pre-rolled filter tips, packages are made available to him, in which these filter tips are either in bulk (this is the case of packaging in the form of plastic or paper bags), or stored next to each other (this is the case of box-like packaging).

But in these two configurations, unless being very careful, there is a high risk that several filter tips slip from the package and fall to the ground. Likewise, if the previously opened package slips from the user's hands, it is likely that a large part of the filter tips will spill out on the ground.

In this context, the closest prior art known to the present applicant consists of WO2015/014999, WO2018/007300, GB2383252 and US2015/189914.

In any event, the present invention aims at providing a complete solution to the problem described above.

SUMMARY OF THE INVENTION

Thus, the present invention relates mainly to a set of filters made of cardboard or cellulosic material, characterized in that it has the shape of a generally cylindrical stick which consists of a plurality of individual filters, each consisting of a winding on itself of a blank of cardboard or cellulosic material, these filters, disposed in the extension of each other, being partially connected in pairs by connecting means, such that it is possible to separate at least one filter from said stick by removing or severing said connecting means, and such that it comprises only a single sheet of cardboard or cellulosic material in which parallel cutouts which individualize said blanks are formed, each of the cutouts being partial that is to say there are, between the cutouts, bridges of material, forming said connecting means, which connect two neighboring blanks.

In this way, the constituent filters of the set form a single "entity" from which the user will take a filter as and when needed.

And in the event that a set slips from the package or falls to the ground, it suffices to recover in a single gesture this set and not a plurality of scattered filters.

In addition, this "stick" presentation allows packaging several sets of the same type in a case (of parallelepiped shape, for example in the format of a packet of cigarettes) or a bag.

Finally, the fact that the set comprises only, that is to say solely, a sheet without any other additional element, contributes to improving its use (any fraction of this set is usable) and to facilitating its manufacture.

According to other non-limiting and advantageous characteristics of this set, taken alone or in any combination:

- said bridges of material are positioned such that they are angularly equidistant at the periphery of each filter;
- this set comprises at least four bridges of material;
- it includes at least five filters;
- it includes at most fifteen filters.

The invention also relates to a preform for the manufacture of a set according to any of the aforementioned characteristics.

This preform is remarkable in that it consists of a sheet of cardboard or cellulosic material in which parallel cutouts which individualize said blanks are formed, each of the cutouts being partial that is to say there are, between the cutouts, bridges of material which connect two neighboring blanks.

Finally, it relates to a packaging for such a set. This set consists of an envelope similar in shape to that of said stick, which includes pre-cutouts which are disposed in such a way that they extend facing the areas which separate the individual filters when a stick is present in said envelope.

BRIEF DESCRIPTION OF THE DRAWINGS

Other characteristics and advantages of the invention will become apparent upon reading the following description of one preferred embodiment of the invention. This description is made with reference to the appended drawings in which.

DETAILED DESCRIPTION OF THE INVENTION

Throughout the present application, including the claims, the terms "tip", "filter" and "filter-tip" are used interchangeably to denote the same object.

Figure 1:
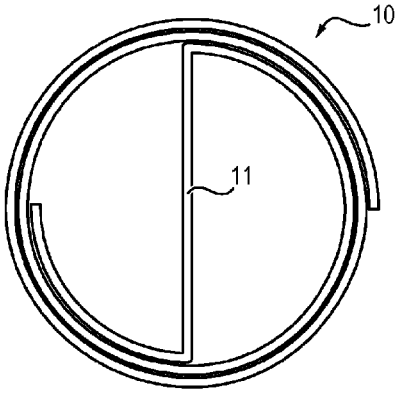
FIG. 1 is a left view of a cardboard filter which may form part of the set according to the present invention.
Figure 2:
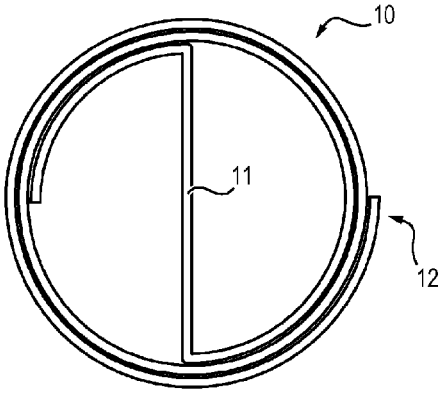
FIG. 2 is a right view of the same filter.
Figure 3:
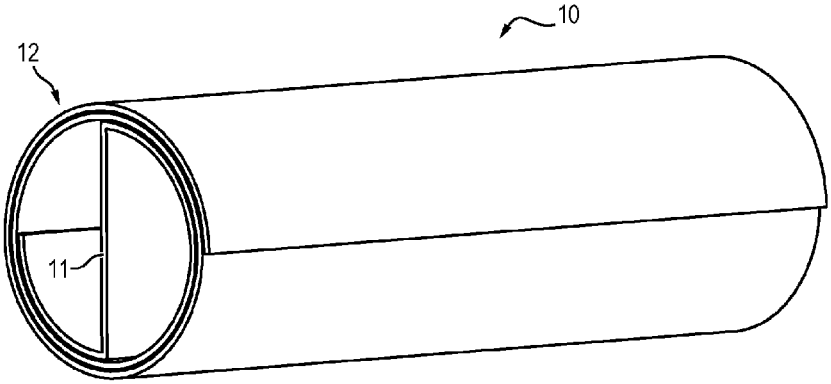
FIG. 3 is a perspective view of the filter of FIGS. 1 and 2.
Figure 4:
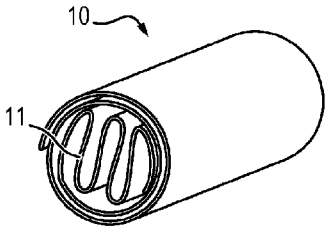
FIG. 4 is a perspective view of another embodiment of this filter.
Figure 5:
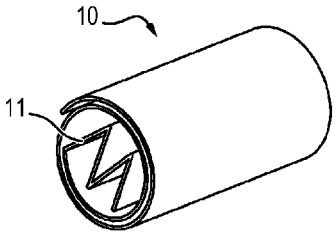
FIG. 5 is a perspective view of yet another embodiment of this filter.
Figure 6:
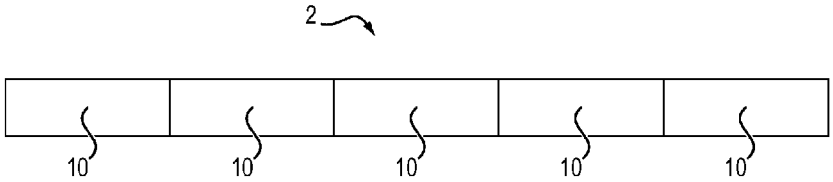
FIG. 6 is a front view of a stick-shaped set, in accordance with the present invention.
Figure 7:
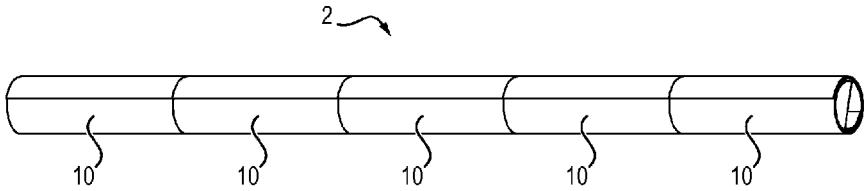
FIG. 7 is a perspective view of the set of FIG. 6.

As it is particularly visible, the appended FIGS. 6 and 7 deal, in accordance with the present invention, with a generally cylindrical stick-shaped set 2 which consists of a plurality of individual and identical filters 10, for example in accordance with one of the embodiments visible in FIGS. 3 to 5 mentioned above, each consisting of a winding on itself a cardboard blank.

These filters 10 are disposed in the extension of each other so as to thus constitute the stick.

The example represented here deal with a set 2 consisting of five filters. This number is absolutely not limiting. It would be possible to form sets including a different number of filters, preferably a greater number. As an indication, this number is less than or equal to 15, so as to constitute sets of reasonable size, compatible with the currently available packages.

In accordance with the invention, the filters 10 of the set 2 are connected in pairs by connecting means, so that it is possible to separate at least one filter 10 from said stick by removing or severing said connecting means.

According to the invention, these connecting means consist of "bridges" of material which connect two neighboring filters 2.

Figure 11:
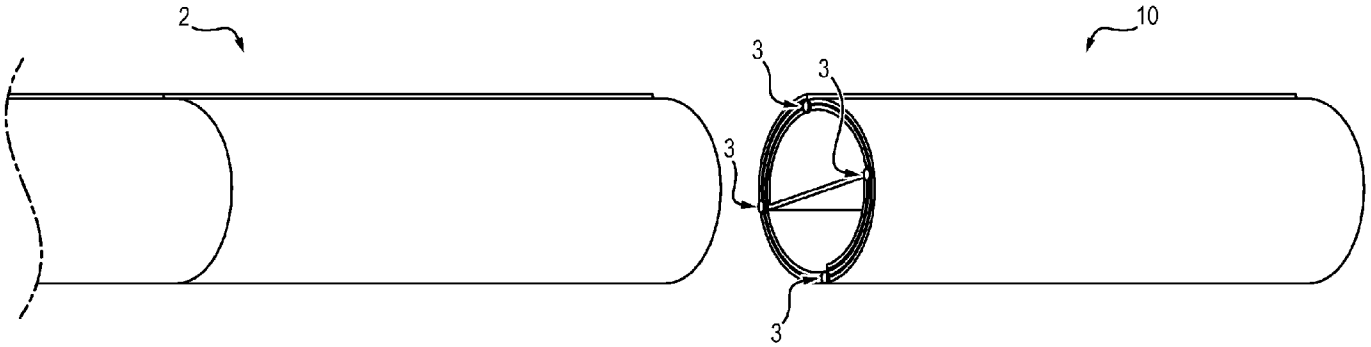
FIG. 11 is a perspective and partial view of the filter and of the set of FIG. 10, intended more particularly to show the "bridges of material" which exist between two neighboring filters.

These bridges or "attachment points", referenced 3, are particularly visible in FIG. 11. They form an integral part of the filters.

These bridges of material are sufficient to make the filters 10 secured to each other and to give some cohesion to the set 2.

Figure 8:
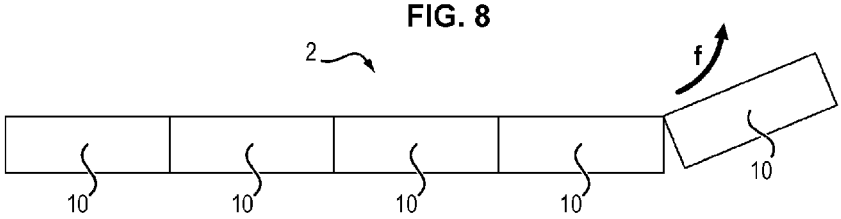
FIG. 8 is a first front view of the set of FIG. 6, representing an end filter being detached.
Figure 9:
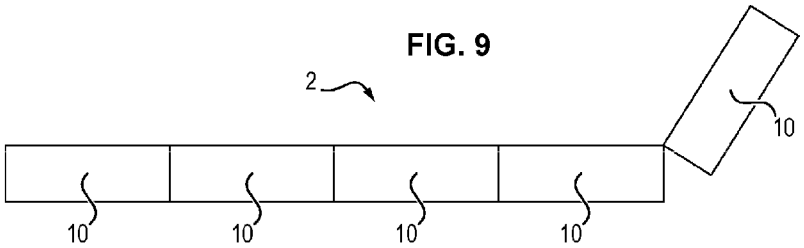
FIG. 9 is a second front view of the set of FIG. 6, representing an end filter being detached.
Figure 10:
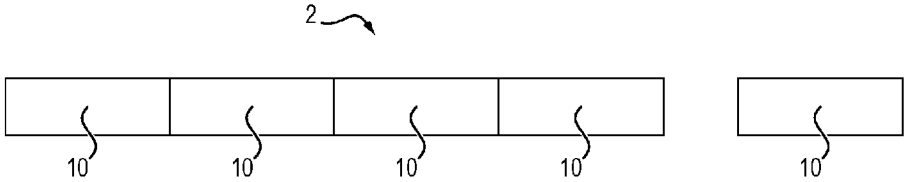
FIG. 10 is still a front view of the set of FIG. 6, the end filter being represented detached from the rest of the set.

However, these bridges 3 are not sufficiently resistant to oppose the separation of a filter 10 (see FIG. 10), after tilting of this filter 10 at an acute angle, as shown by the arrow f in FIG. 8. If necessary, this tilting movement can be continued until obtaining a larger angle, close to the right angle, as shown in FIG. 9.

The tilting forces the material of the filters, so that the bridges 3 break and burst. Thus, the filter 10 is detached from the other ones and is ready to be used. It should be noted that there is no residue or other material to throw away, because the bridges 3 form an integral part of the filters 10 and consist of the same material. In other words, any fraction of this set is usable. The fact that the bridges 3 form part of the filters makes the use of the set extremely easy and simplifies its manufacture.

If necessary, this titling movement can be combined with a slight pulling movement, once the user feels that the end filter 10 is about to separate from the set 2.

In a particularly advantageous manner, the bridges are distributed angularly equidistant at the periphery of each filter, so as to give uniform cohesion to the set and allow easy separation.

Of course, each time the user wishes to take a filter 10, he operates in the same way as described above.

Figure 12:
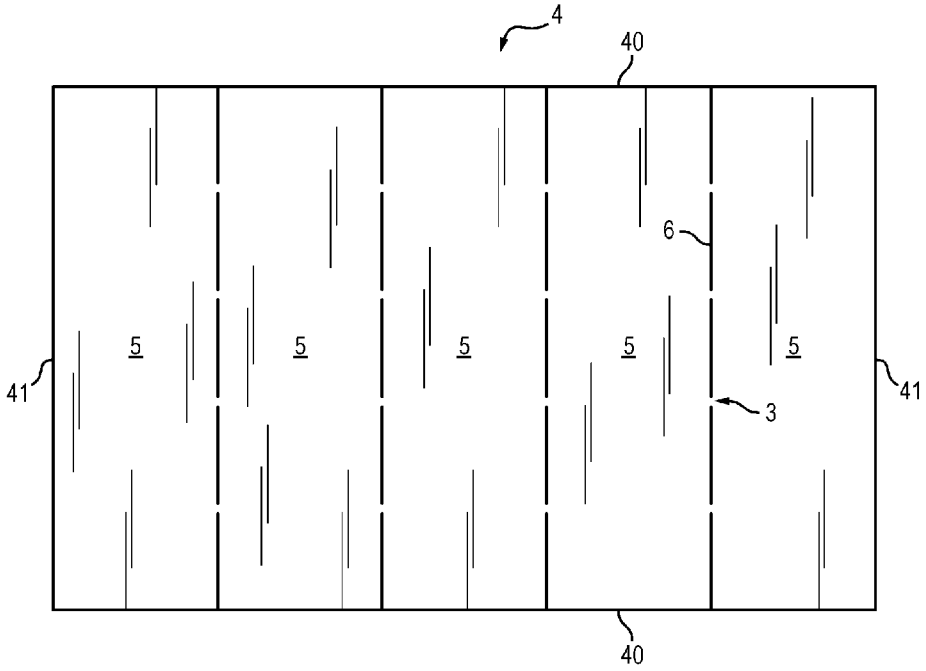
FIG. 12 is a top view of a "preform" which allows obtaining a set according to the invention.
Figure 13:
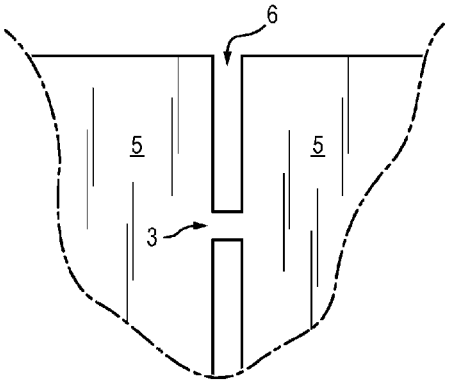
FIG. 13 is a detail view of FIG. 12.

To obtain such a set 2, a preform 4 such as the one represented in the appended FIG. 12 is preferably used.

This preform 4 consists of an elongated rectangular cardboard web, whose parallel long sides are referenced 40 and the short sides are referenced 41.

In this perform 4, five strips 5 whose long sides extend parallel to the short sides 41 of the preform 4 are individualized.

Each strip is separated from its neighbor (neighbors) by partial cutouts 6 which are separated by the aforementioned bridges of material 3.

The production of the pre-cutouts is preferably implemented using an automated machine which will not be described here because it does not constitute the core of the invention.

The preform 4 is then wound on itself in a manner similar to what is already produced and known for making individual filters. Here again, an automated machine is preferably used. As soon as the preform takes its final stick shape, a string of glue is placed in order to ensure the cohesion of this stick over time.

The preform 4 may optionally have additional pre-cutouts over part of its thickness, to facilitate the shaping of the filters, as explained in FR 3057441 mentioned above.

In addition to the aforementioned advantages related to the use of the aforementioned set 2, the manufacture of this set from a preform 4 allows rationalizing this operation.

The present invention also relates to packaging for such a set. This has not been represented in the figures so as not to weigh them down unnecessarily.

Such a packaging for a set 2 such as the one described above consists of an envelope of shape similar to that of said aforementioned stick. In other words, it also has a stick shape and is dimensioned to allow inserting a set therein, while enclosing it. This envelope includes pre-cutouts which are disposed in such a way that they extend facing the areas which separate the individual filters 10 when a stick is present in said envelope.

Advantageously, this packaging is transparent or translucent, so that the consumer can easily see the number of present filters. It is possible to envisage that the material which constitutes this packaging is the same as that of the transparent packaging of cigarette packets.

When the consumer wishes to take a filter from the packaging, with a single gesture, he will break one of the pre-cutouts of the packaging, as well as the pre-cutout facing the set 2.

In addition to the advantages already described relating to the present invention, it can be noted that it is extremely easy to transport a stick-shaped set (consisting for example of six filters), for mobile use without dispersing or losing said filters.

The consumer can successively take a filter, so that the stick is reduced but remains compact and in one piece.

The invention claimed is:

1. A set of filters made of cardboard or cellulosic material, wherein said set has the shape of a generally cylindrical stick which consists of a plurality of individual filters, each consisting of a winding on itself of a blank of the cardboard or cellulosic material, said filters, disposed in an end-to-end arrangement adjacent each other, being partially connected in pairs by connecting means, such that it is possible to separate at least one of said filters from said stick by removing or severing said connecting means, and wherein said set comprises only a single sheet of cardboard or cellulosic material in which parallel cutouts which individualize seach filter are formed, and each of the cutouts are partial in that there are, between said cutouts, bridges of material, forming said connecting means, which connect two adjacent blanks.

2. The set according to claim 1, wherein said bridges of material are positioned such that they are angularly equidistant at the periphery of each filter.

3. The set according to claim 1, wherein it comprises at least four bridges of material.

4. The set according claims 1, wherein it includes at least five filters.

5. The set according to claim 1, wherein it includes at most fifteen filters.

* * * * *